US006983870B2

(12) United States Patent
Hancock et al.

(10) Patent No.: US 6,983,870 B2
(45) Date of Patent: Jan. 10, 2006

(54) SUSPENDED ARTICLE HOLD DOWN SYSTEM

(75) Inventors: Dennis Hancock, Mountain Green, UT (US); Jeffrey D. Hancock, Uintah, UT (US)

(73) Assignee: Stearns Inc., Sauk Rapids, MN (US)

( * ) Notice: Subject to any disclaimer, the term of this patent is extended or adjusted under 35 U.S.C. 154(b) by 100 days.

(21) Appl. No.: 10/345,452

(22) Filed: Jan. 17, 2003

(65) Prior Publication Data

US 2004/0178239 A1 Sep. 16, 2004

(51) Int. Cl.
*A45F 3/14* (2006.01)

(52) U.S. Cl. ..... 224/258; 224/259; 224/909; 359/409

(58) Field of Classification Search ..... 224/257, 224/258, 259, 609, 909; 359/409
See application file for complete search history.

(56) References Cited

U.S. PATENT DOCUMENTS

| | | | | | |
|---|---|---|---|---|---|
| 2,643,803 | A | * | 6/1953 | Bates | 224/254 |
| 3,152,738 | A | * | 10/1964 | Worsfold, Jr. | 224/259 |
| 3,326,432 | A | * | 6/1967 | Banks et al. | 224/258 |
| 3,526,347 | A | * | 9/1970 | Kuban | 224/259 |
| 4,033,488 | A | * | 7/1977 | Brewer | 224/259 |
| 4,232,808 | A | | 11/1980 | Gray | |
| 4,461,411 | A | | 7/1984 | Harrow | |
| 5,016,797 | A | * | 5/1991 | Rowledge | 224/257 |
| 5,320,261 | A | | 6/1994 | Andersen | |
| 5,662,252 | A | * | 9/1997 | Martin | 224/250 |
| RE37,155 | E | | 5/2001 | Andersen | |
| 6,305,538 | B1 | | 10/2001 | Jackson | |
| 6,648,191 | B2 | * | 11/2003 | Giggleman | 224/260 |
| 2003/0029895 | A1 | | 2/2003 | Andersen | |
| 2004/0140335 | A1 | | 7/2004 | Hancock et al. | |

OTHER PUBLICATIONS

"Bino–hide," *Sportsman Outdoor Products*, 1 page (Product Package—date unknown).
"Dual Strap Binocular Harness," *Cabela's*, 1 page (Product Package—date unknown).
"Bino Buddy Binocular Strap," *Cabelas*, www.cabelas.com, 1 page, date first available unknown.
"Butler Creek Bino Buddy," *Cabelas*, www.cabelas.com, 1 page, date first available unknown.
"Slide & Flex Bino System," *Crooked Horn Outfitters*, www.crookedhorn.com, 2 pages (Believed to have been on sale before Jan. 17, 2002).

* cited by examiner

*Primary Examiner*—Stephen K. Cronin
(74) *Attorney, Agent, or Firm*—Merchant & Gould P.C.

(57) ABSTRACT

A suspended article hold down system for suspending articles such as binoculars, cameras, and eyeglasses that are commonly attached to neck straps, by shoulder straps and then providing a hold down strap to extend across such an article suspended by the shoulder straps, the hold down strap being releasably connected to ends of underarm straps having opposite ends connected to the shoulder straps through a flat spreader at the back of a user of the system.

19 Claims, 3 Drawing Sheets

SUSPENDED ARTICLE HOLD DOWN SYSTEM

CROSS REFERENCE TO RELATED APPLICATION

Not Applicable

STATEMENT REGARDING FEDERALLY SPONSERED RESEARCH OR DEVELOPEMENT

Not Applicable

REFERENCE TO MICROFICHE APPENDIX

Not Applicable

BACKGROUND OF THE INVENTION

This invention relates to apparatus for holding strap support articles in place against the chest of a user while the articles are being carried and not in use.

There are many situation where users want to have an article such as binoculars, a camera or eyeglass ready and available for immediate use but do not want to have to carry the article in hand, or in a carrying case dangling on the end of a neck strap. With the article carried in hand the hand is no longer available for other activities. If the carrying case is used the article contain therein can usually only be retrived for use by unlocking the case and withdrawing the article. Often, this procedure is so slow that by the time the article is pulled from the case it is too late for the user to use the article in the manner desired. Futhermore, a neck suspended article case swings and flops against the chest of a person carrying the article as well as from side to side. Even if a carrying case is not used and the article itself is suspended from a neck strap the article swing's and flops and is often annoying and uncomfortable to the user as various activities are performed. Running, climbing over or through fences, riding on or in various vehicles and even riding in a boat in rough water are typical of activities that will cause neck strap suspended articles, whether or not in a carrying case, to repeatedly hit and bounce off the chest of a user.

BRIEF SUMMARY OF THE INVENTION

It is a principal object of the present invention to provide a system for carrying chest positioned articles such that the articles will be restrained against undesired swinging against the body of the user and from side to side. Another object is to provide a system for carrying supported articles that will permit fast and easy single movement release of the article from a hold down position to a use position.

Still other objects are to provide apparatus for supporting articles such as binoculars, cameras and eyeglasses that are commonly suspended by a neck strap against the chest area of a user and that are commonly used by raising them to appropriate eye level to permit viewing and aiming. Yet other objects are to provide apparatus that is easy to use, long lasting,

DETAILED DESCRIPTION OF THE INVENTION

Figure 1:
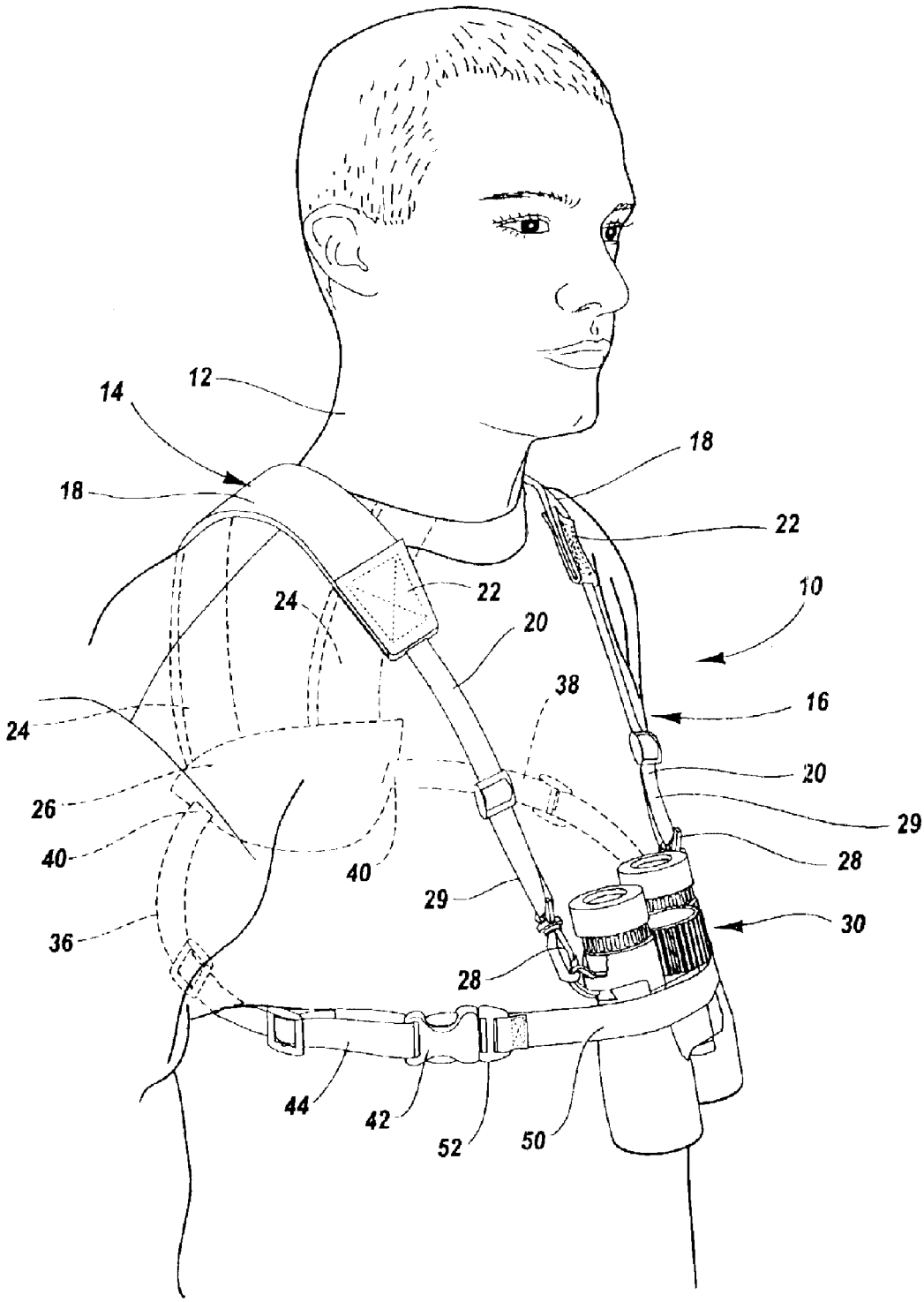
FIG. 1 is a pictorial right/front view of the chest supported article holder of the invention on a user and with the neck supported article (binoculars) secured against undesired movement.
Figure 2:
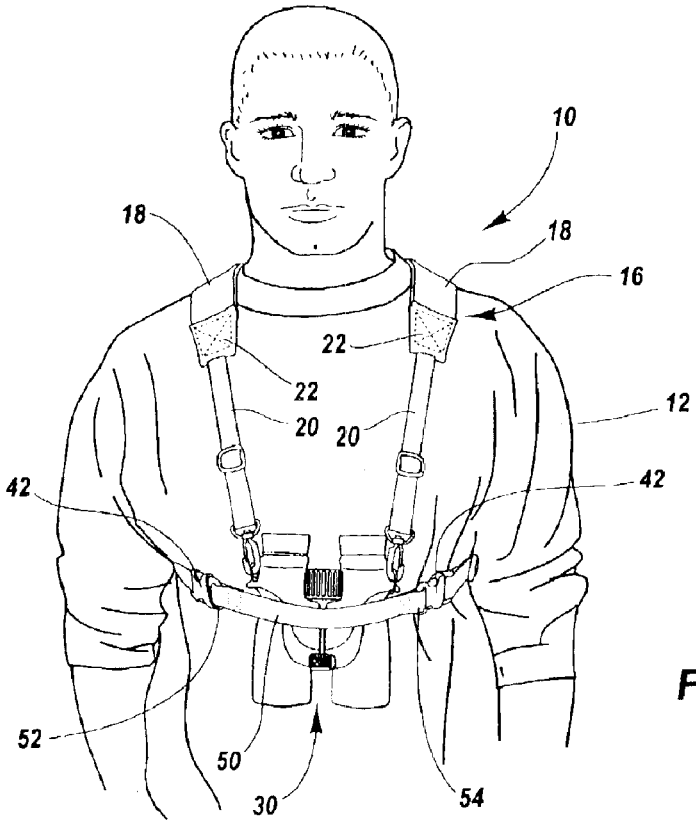
FIG. 2, a pictorial front view.
Figure 3:
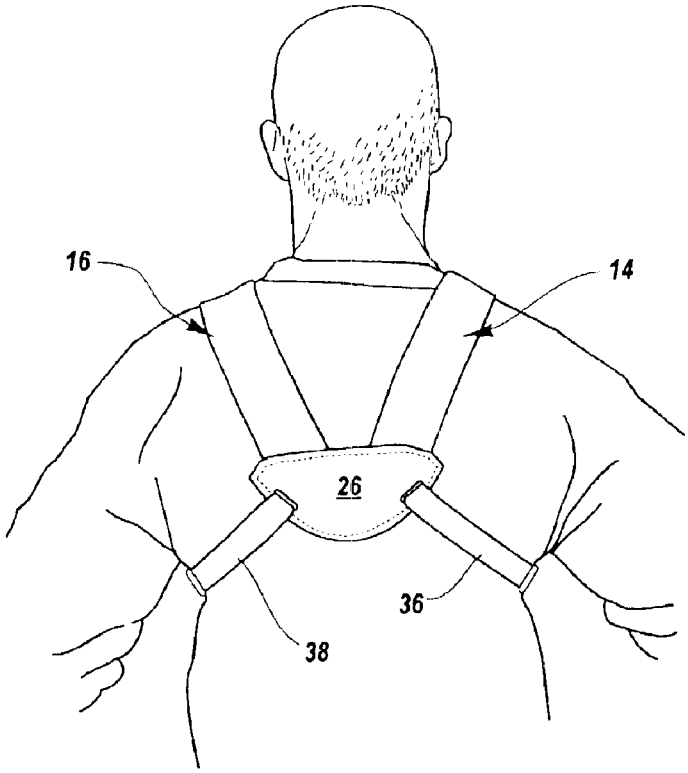
FIG. 3, a pictorial rear view.
Figure 4:
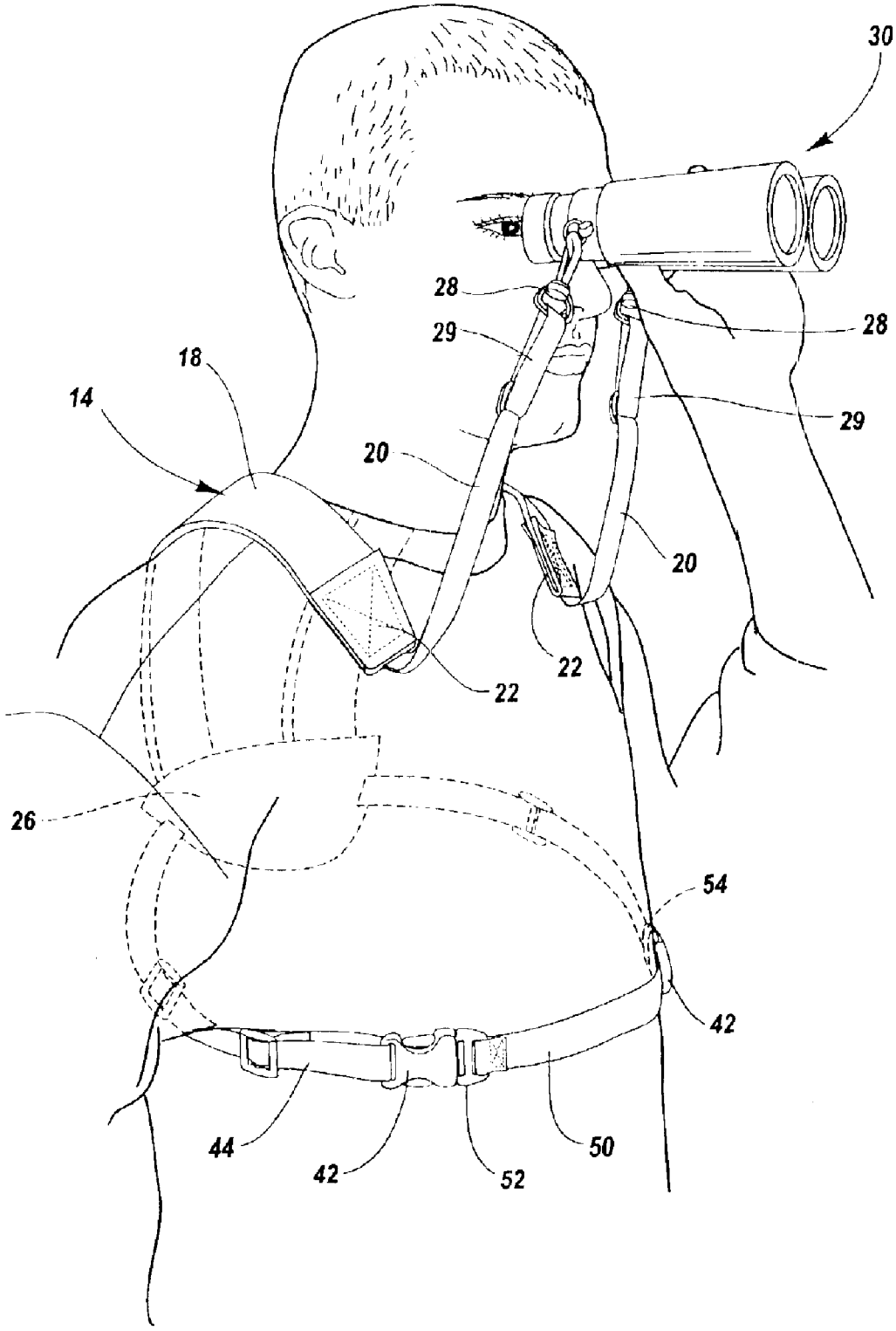
FIG. 4, a view like that of FIG. 1, but showing the article (binoculars) raised to eye level.

Referring now to the drawings:

In the illustrated preferred embodiment of the invention the suspended article hold down system is shown generally at 10, worn by a user 12.

System 10 includes a pair of shoulder straps 14 and 16, each having a resilient (elastic) length 18 and an adjustable non-resilient (non-elastic) length 20. A reinforcement pad 22 is provided at each of the connections between the lengths 18 and the lengths 20.

One end 24 of each shoulder strap 14 and 16 is connected to a flat spreader 26 and, in use, each strap extends from the spreader upwardly from the back of a user and over a shoulder of the user. A snap connector 28 is connected to turned back ends of each non-resilient length 20 of each shoulder strap 14 and 16. The snap connectors 28 of the respective straps 14 and 16 are attached to opposite sides of an article, here shown as binoculars 30, that is commonly suspended by a strap (not shown) from the neck of the user.

A pair of adjustable length resilient (elastic) underarm straps 36 and 38 each have one end 40 attached to spreader 26. Each underarm strap 36 and 38 extends from the spreader 26 beneath an arm of the user 12 and around the front of the user. A quick release coupling receptacle 42 is connected to turned back ends 44 and 46 respectively of the underarm straps 36 and 38.

A resilient (elastic) hold down strap 50 has coupling inserts 52 and 54 secured at opposite ends thereof.

In using the suspended article hold down system 10 of the invention a user 12 will position spreader 26 flat against his back and the shoulder straps 14 and 16 to extend over his shoulders. The shoulder straps are them connected to an article (binoculars 30) or another article such as a camera, not shown, eyeglasses, not shown, or other such article that is used by a user raising the article for viewing, sighting or aiming. The lengths of the shoulder straps and underarm straps are adjusted to provide a comfortable fit on the user. The hold down strap is connected to the underarm straps and the hold down strap is arranged to overlie the article, thereby holding the article against undesired swinging. The hold down strap may be of a resilient (elastic) material when a tighter holding action is desired.

The article can be raised for use by merely first sliding the article hold down strap off the article while raising the article to the use position. When the article is again out of use it is merely dropped, to the extent allowed by the attached shoulder straps. The hold down strap is then merely pulled into place extending across the article.

Although a preferred embodiment of the invention has been herein disclosed, it is to be understood that such disclosure is by way of example and that other variations are possible without departing from the subject matter coming within the scope of the following claims, which subject matter we regard as our invention. suitable for use with a wide variety of articles and that is inexpensive to manufacture so that it is readily available to a wide range of users.

Principal features of the invention include a strap assembly including a pair of shoulder straps each having one end connected to a side of an article to be suspended; a spreader to which the other ends of the shoulder straps are secured; a pair of underarm straps, each having one end fixed to the spreader and another end attached to a resilient hold-down strap. The shoulder straps and underarm straps are each made of interconnected stretchable and non-stretchable fabric materials and are made to be adjusted lengthwise, as necessary to accommodate the body size and shape of a user.

Additional objects and features of the invention will become apparent to those skilled in the art to which the invention pertains from the following detailed description and drawings.

We claim:

1. A suspended article hold down system, comprising:

a pair of flexible shoulder straps to fit over the shoulders of a user, the shoulder straps each having a resilient length and a non-resilient length;

a separate snap hook on one end of each shoulder strap for connection of the strap to one side of an article to be suspended in front of the user;

a flat spreader connected to ends of the shoulder straps that are opposite to those ends connected to the snap hooks;

a pair of underarm straps each having one end connected to the spreader and having sufficient length to extend from the spreader at the back of a user, beneath the arms of the user, to the front of the user; and a hold down strap connected between ends of the underarm straps that are remote from the spreader, the hold down strap being configured to extend over the article suspended in front of the user by the shoulder straps.

2. A suspended article hold down system as in claim 1, wherein the hold down strap is elastic.

3. A suspended article hold down system as in claim 1, wherein the underarm straps are resilient and adjustable in length.

4. A suspended article hold down system as in claim 3, further comprising a releasable coupling configured to connect opposite ends of the hold down strap to end of each underarm strap.

5. A suspended article hold down system as in claim 4, wherein the hold down strap is elastic.

6. A suspended article hold down system, comprising:

a pair of flexible shoulder straps to fit over the shoulders of a user;

a separate snap hook on one end of each shoulder strap for connection of the strap to one side of an article to be suspended in front of the user;

a flat spreader connected to ends of the shoulder straps that are opposite to those ends connected to the snap hooks;

a pair of underarm straps each having one end connected to the spreader and having sufficient length to extend from the spreader at the back of a user, beneath the arms of the user, to the front of the user; and an elastic hold down strap connected between the ends of the underarm straps that are remote from the spreader, the hold down strap being configured to extend over the article suspended in front of the user by the shoulder straps.

7. A suspended article hold down system as in claim 6, wherein the shoulder straps each include a resilient length and a non-resilient adjustable length.

8. A suspended article hold down system as in claim 6, wherein the underarm straps are resilient and adjustable in length.

9. A suspended article hold down system as in claim 6, further comprising a releasable coupling configured to connect opposite ends of the hold down strap to an end of each underarm strap.

10. A suspended article hold down system, comprising:

a pair of shoulder straps to fit over the shoulders of a user, each shoulder strap having first and second ends, the first end being positioned at a front side of the user and the second ends being positioned at a rear side of the user;

a separate connector coupled to the first end of each shoulder strap for connection of the strap to an article to be suspended by the hold down system;

a flat spreader coupled to the second end of each shoulder strap;

at least one underarm strap having first and second ends, the first end being positioned at the front of the user and the second end being coupled to the spreader, wherein each underarm strap extends beneath an arm of the user; and a hold down strap connected to the first end of each underarm strap, the hold down strap being configured to extend over the article suspended by the shoulder straps to hold the article against the user.

11. The hold down system of claim 10, wherein the hold down strap comprises an elastic material.

12. The hold down system of claim 10, wherein each of the shoulder straps include first and second portions, the first portion comprising a non-resilient material and the second portion including a resilient material.

13. The hold down system of claim 10, wherein the connector includes a quick release device.

14. The hold down system of claim 10, wherein the shoulder straps are coupled to the article only at the front side of the user, and are not coupled to the hold down strap or the underarm straps at the front of the user.

15. A method of suspending and holding an article over shoulders of a user, the method comprising:

positioning first and second shoulder straps over first and second shoulders of the user, each shoulder strap including first and second ends, wherein the second ends of the shoulder straps are coupled to each other at a rear side of the user, and the first ends of the shoulder straps are coupled to the article to suspend the article at a front side of the user;

positioning first and second underarm straps under separate arms of the user, each underarm strap including first and second ends, wherein the second ends of the underarm straps are coupled to the second ends of the shoulder straps, and the first ends of the underarm straps are coupled to each other at the front side of the user;

coupling a hold down strap between the first ends of the underarm straps; and positioning the article between the user and the hold down strap to hold the article in a desired position.

16. The method of claim 15, wherein a flat spreader is coupled between ends of the underarm straps and ends of the shoulder straps at the rear side of the user.

17. The method of claim 15, wherein the shoulder straps comprise a resilient material.

18. The method of claim 15, wherein positioning the article includes moving the hold down strap away from the user against biasing forces exerted by the hold down strap, positioning the article in the space provided between the moved hold down strap and the user, and releasing the hold down strap wherein the biasing forces of the hold down strap hold the article against the user.

19. The method of claim 15, wherein the shoulder straps are coupled to the article only at the front side of the user, and are not coupled to the hold down strap or the underarm straps at the front of the user.

* * * * *